US005748200A

United States Patent [19]

Funahashi

[11] Patent Number: 5,748,200

[45] Date of Patent: May 5, 1998

[54] IMAGE DISPLAYING APPARATUS

[75] Inventor: Takeshi Funahashi, Kanagawa-ken, Japan

[73] Assignee: Fuji Photo Film Co., Ltd., Kanagawa, Japan

[21] Appl. No.: 620,257

[22] Filed: Mar. 22, 1996

[30] Foreign Application Priority Data

Mar. 23, 1995 [JP] Japan ..... 7-063892

[51] Int. Cl.[6] ..... G09G 5/00

[52] U.S. Cl. ..... 345/507; 345/112

[58] Field of Search ..... 345/185, 189, 345/192, 201, 203, 112, 121, 123, 127, 507, 508, 509, 511, 521; 395/507, 508, 521, 172

[56] References Cited

U.S. PATENT DOCUMENTS 5,134,424 7/1992 Oomori ..... 346/1.1

5,317,399 5/1994 Satake et al. ..... 348/571

*Primary Examiner*—Dennis-Doon Chow

*Attorney, Agent, or Firm*—Sughrue, Mion, Zinn, Macpeak & Seas, PLLC

[57] ABSTRACT

An image displaying apparatus comprises a first storage device for storing a plurality of kinds of setting information for setting a display mode, in which images are displayed, a second storage device for storing various combination patterns of the plurality of kinds of setting information, which are stored in the first storage device, and an input device for inputting identification information. In accordance with the inputted identification information, a first selection device selects a combination pattern, which corresponds to the inputted identification information, from the second storage device. In accordance with the selected combination pattern, a second selection device selects pieces of setting information, which correspond to the selected combination pattern, from the first storage device. A display device displays the images in a display mode, which corresponds to the selected pieces of setting information.

9 Claims, 2 Drawing Sheets

IMAGE DISPLAYING APPARATUS

BACKGROUND OF THE INVENTION

1. Field of the Invention

This invention relates to an image displaying apparatus for reproducing visible images from image signals and displaying them. This invention particularly relates to an image displaying apparatus for displaying images in a desired display form.

2. Description of the Prior Art

Techniques for utilizing filing systems have heretofore been carried out. With the techniques, a plurality of image signals representing a plurality of images are stored in a filing system, which is provided with a storage medium, such as an optical disk. When necessary, a desired image signal is read from the filing system, and a visible image is reproduced from the image signal.

In the filing systems, a plurality of image signals representing a plurality of images of a single object, such as a patient, which images are related to one another, are often stored on the storage medium. Examples of the plurality of images, which are related to one another, include a plurality of tomographic images of a single object, such as a human body, which are recorded successively, e.g. computed tomography (CT) images and magnetic resonance imaging (MRI) images, and a plurality of contrasted images, which are obtained by recording the images of different portions of a single object such that, for example, as in a gastric examination, the state of movement of swallowed barium from the esophagus to the stomach can be viewed. When the plurality of images, which are related to one another, are to be viewed, necessary operations have heretofore been carried out by a person (e.g. a medical doctor), who view the images, such that the images may be reproduced from the corresponding image signals and may be displayed in a desired display form on an image reproducing means, such as a cathode ray tube (CRT) display device. As an example of the display form, the plurality of images, which are related to one another, are displayed one after another on the CRT display device. As another example of the display form, the display area of the CRT display device is divided into a plurality of windows, and the images, which are related to one another, are displayed respectively in the windows. As a further example of the display form, all of the images, which are related to one another, are displayed simultaneously as index images. As a still further example of the display form, in cases where the number of the images, which are related to one another, is 12, they are displayed by being arrayed in a form of 3×4 frames. Also, display conditions, such as the order in which the plurality of images are sorted, the grouping of the images, image processing conditions, an image display direction, and the scale of enlargement of an image, are set such that the images may be displayed under desired display conditions. The display forms and the display conditions described above will hereinbelow be referred to as the display modes.

A desired display mode is set in the manner described below. Specifically, a plurality of kinds of setting information, which define the image display modes, are stored on a storage means of an image displaying apparatus. The person, who view the images, selects desired pieces of setting information from the plurality of kinds of setting information and thereby sets the mode, in which the images are to be displayed. The images are thus displayed in the desired display mode.

However, in the storage means, a plurality of pieces of display mode setting information are stored for each of the plurality of kinds of setting information, such as the information for setting the image display form, the information for setting the order in which the plurality of images are sorted, the information for setting the grouping of the images, the information for setting the image processing conditions, the information for setting the image display direction, and the information for setting the scale of enlargement of an image. Therefore, each time the images are to be displayed, the desired pieces of setting information must be selected from the plurality of kinds of setting information such that the images may be displayed in the desired display mode. Considerable time and labor are required to carry out such operations.

Also, when a person views the images, he ordinarily wants to display the images in a predetermined display mode.

SUMMARY OF THE INVENTION

The primary object of the present invention is to provide an image displaying apparatus, wherein a desired display mode is capable of being set easily.

Another object of the present invention is to provide an image displaying apparatus, wherein selection of setting information is capable of being carried out quickly.

The present invention provides a first image displaying apparatus, wherein desired pieces of setting information are selected from a plurality of kinds of setting information for setting a display mode, in which images are displayed, and wherein the images are displayed in a desired display mode in accordance with the selected pieces of setting information, comprising:

i) a first storage means for storing the plurality of kinds of setting information, ii) a second storage means for storing various combination patterns of the plurality of kinds of setting information, which are stored in the first storage means, iii) an input means for inputting identification information, iv) a first selection means for selecting a combination pattern, which corresponds to the inputted identification information, from the second storage means and in accordance with the inputted identification information, v) a second selection means for selecting pieces of setting information, which correspond to the selected combination pattern, from the first storage means and in accordance with the selected combination pattern, and vi) a display means for displaying the images in a display mode, which corresponds to the selected pieces of setting information.

Specifically, a plurality of pieces of identification information (hereinbelow referred to as the ID information), corresponding combination patterns, and corresponding pieces of setting information are prepared previously. By the input of the ID information, desired pieces of setting information are selected from the plurality of kinds of setting information.

The term "combination pattern" as used herein means one of various combinations of pieces of setting information selected from the plurality of kinds of setting information. In the present invention, the combination pattern may be composed of only a single kind of setting information.

The present invention also provides a second image displaying apparatus, wherein desired pieces of setting information are selected from a plurality of kinds of setting information for setting a display mode, in which images are displayed, and wherein the images are displayed in a desired display mode in accordance with the selected pieces of setting information, comprising:

i) a storage means for storing the plurality of kinds of setting information, ii) an input means for inputting one of various combination patterns of the plurality of kinds of setting information, which are stored in the storage means, iii) a selection means for selecting pieces of setting information, which correspond to the inputted combination pattern, from the storage means and in accordance with the inputted combination pattern, and vi) a display means for displaying the images in a display mode, which corresponds to the selected pieces of setting information.

Specifically, in the second image displaying apparatus in accordance with the present invention, the information concerning the combination pattern is inputted in lieu of the ID information, and the desired pieces of setting information are thereby selected.

With the first image displaying apparatus in accordance with the present invention, the plurality of kinds of setting information are stored in the first storage means. Various combination patterns of the plurality of kinds of setting information are stored in the second storage means. In accordance with the inputted ID information, the combination pattern corresponding to the inputted ID information is selected by the first selection means. Also, the pieces of setting information, which correspond to the selected combination pattern, are selected by the second selection means. The images are displayed in the desired display mode in accordance with the selected pieces of setting information. In this manner, only by the operation for inputting the ID information, the desired pieces of setting information can be selected, and the images can be displayed in the desired display mode. Therefore, it is not necessary for the operator to carry out the operations for selecting the desired pieces of setting information from the plurality of kinds of setting information each time the images are to be displayed. Accordingly, the images can be displayed in the desired display mode without the operations for selecting the setting information, which require considerable time and labor, being carried out.

With the second image displaying apparatus in accordance with the present invention, in lieu of the ID information, the combination pattern is inputted. Therefore, it is not necessary to make clear which combination pattern corresponds to which ID information, and the selection of the setting information can be carried out quickly.

DESCRIPTION OF THE PREFERRED EMBODIMENTS

The present invention will hereinbelow be described in further detail with reference to the accompanying drawings.

Figure 1:
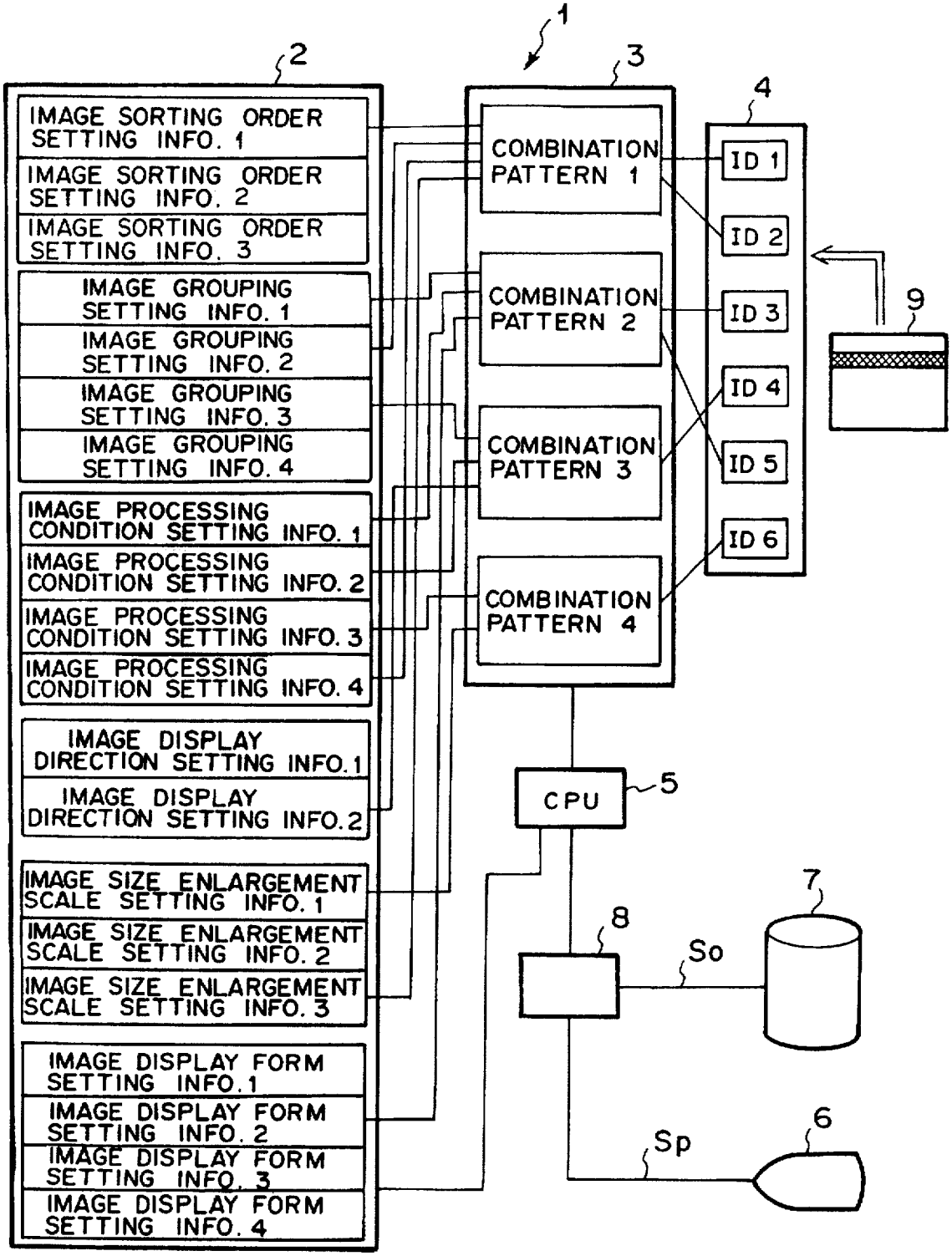
FIG. 1 is a block diagram showing an embodiment of the image displaying apparatus in accordance with the present invention.

FIG. 1 is a block diagram showing an embodiment of the image displaying apparatus in accordance with the present invention. With reference to FIG. 1, an image displaying apparatus 1, which is an embodiment of the image displaying apparatus in accordance with the present invention, comprises a first storage means 2 for storing a plurality of kinds of setting information, and a second storage means 3 for storing various combination patterns of the plurality of kinds of setting information, which are stored in the first storage means 2. The image displaying apparatus 1 also comprises an ID information input means 4 for inputting identification information, which corresponds to each of the combination patterns, and a CPU 5 for operating the image displaying apparatus 1. The CPU 5 is provided with a first selection means for selecting a combination pattern, which corresponds to the inputted identification information, from the second storage means 3 and in accordance with the inputted identification information. The CPU 5 is also provided with a second selection means for selecting pieces of setting information, which correspond to the selected combination pattern, from the first storage means 2 and in accordance with the selected combination pattern. The image displaying apparatus 1 further comprises a CRT display device 6 serving as a display means for displaying a plurality of images in a display mode, which corresponds to the selected pieces of setting information. The image displaying apparatus 1 still further comprises a magnetic disk 7 for storing image signals, which are used for the reproduction of the images on the CRT display device 6, and an image processing means 8 for processing the image signals, which have been read from the magnetic disk 7, in accordance with the selected display mode.

In this embodiment, the first storage means 2 stores three pieces of setting information for setting the order in which the images are sorted, and four pieces of setting information for setting the grouping of the images. The first storage means 2 also stores four pieces of setting information for setting the image processing conditions, and two pieces of setting information for setting the image display direction. The first storage means 2 further stores three pieces of setting information for setting the scale of enlargement of an image, and four pieces of setting information for setting the image display form.

The second storage means 3 stores four combination patterns of the plurality of kinds of setting information. A combination pattern 1 corresponds to image sorting order setting information 1, image grouping setting information 2, image processing condition setting information 4, and image size enlargement scale setting information 3. A combination pattern 2 corresponds to image grouping setting information 1, image processing condition setting information 1, and image display form setting information 2. A combination pattern 3 corresponds to image grouping setting information 3, image processing condition setting information 2, and image display direction setting information 2. A combination pattern 4 corresponds to image size enlargement scale setting information 1 and image processing condition setting information 3.

Also, the combination pattern 1 corresponds to ID information 1 and ID information 2. The combination pattern 2 corresponds to ID information 3 and ID information 5. The combination pattern 3 corresponds to ID information 4. The combination pattern 4 corresponds to ID information 6.

How this embodiment operates will be described hereinbelow.

Firstly, when visible images are to be reproduced from the image signals stored on the magnetic disk 7 and displayed, a person (e.g. a medical doctor), who views the images, inputs his ID information from the ID information input means 4. The ID information may be inputted with an ID card 9, which may be constituted of an IC memory card, a magnetic card, or the like. Alternatively, the ID information input means 4 may be constituted of a means capable of discriminating the ID information in accordance with a radio signal, and the ID information may be inputted from a means, which is capable of transmitting a radio signal representing the ID information by utilizing an ID badge, or the like. As another alternative, the ID information may be inputted by entering information, which represents the name of the person, who views the images, from a keyboard, or the like. In this embodiment, by way of example, the ID information 1 is inputted.

When the ID information is inputted from the ID information input means 4, the CPU 5 selects the combination pattern, which corresponds to the inputted ID information, from the second storage means 3 and in accordance with the inputted ID information. In this embodiment, the ID information 1 is inputted, and therefore the combination pattern 1 is selected.

Thereafter, in accordance with the selected combination pattern, the CPU 5 selects the pieces of setting information, which correspond to the selected combination pattern, from the first storage means 2. In this embodiment, the combination pattern 1 is selected. Therefore, the image sorting order setting information 1, the image grouping setting information 2, the image processing condition setting information 4, and the image size enlargement scale setting information 3 are selected from the first storage means 2.

The CPU 5 then reads image signals $S_o$ from the magnetic disk 7 and causes the image processing means 8 to process the image signals $S_o$ in accordance with the selected pieces of setting information. In accordance with the selected pieces of setting information, the image processing means 8 carries out an exchange of the image sorting order, image grouping, image processing, and image size enlargement or reduction. Processed image signals $S_p$ are obtained from the predetermined processing carried out by the image processing means 8. The CPU 5 feeds the processed image signals $S_p$ into the CRT display device 6. The CRT display device 6 reproduces visible images from the processed image signals $S_p$ and displays the visible images.

As described above, with the image displaying apparatus 1, only by the input of the ID information, the pieces of setting information, which determine the display mode corresponding to the ID information, are selected, and the images are displayed in accordance with the selected pieces of setting information. Therefore, it is not necessary for the operator to carry out the operations for selecting the desired pieces of setting information from the plurality of kinds of setting information, such that the images may be displayed in the desired display mode, each time the images are to be displayed. Accordingly, the images can be easily displayed in the desired display mode.

In the embodiment described above, the ID information is inputted, the combination pattern corresponding to the inputted ID information is selected from the second storage means 3, and the pieces of setting information corresponding to the selected combination pattern are selected. Alternatively, as illustrated in FIG. 2, the information concerning the combination pattern of setting information may be inputted in lieu of the ID information.

Figure 2:
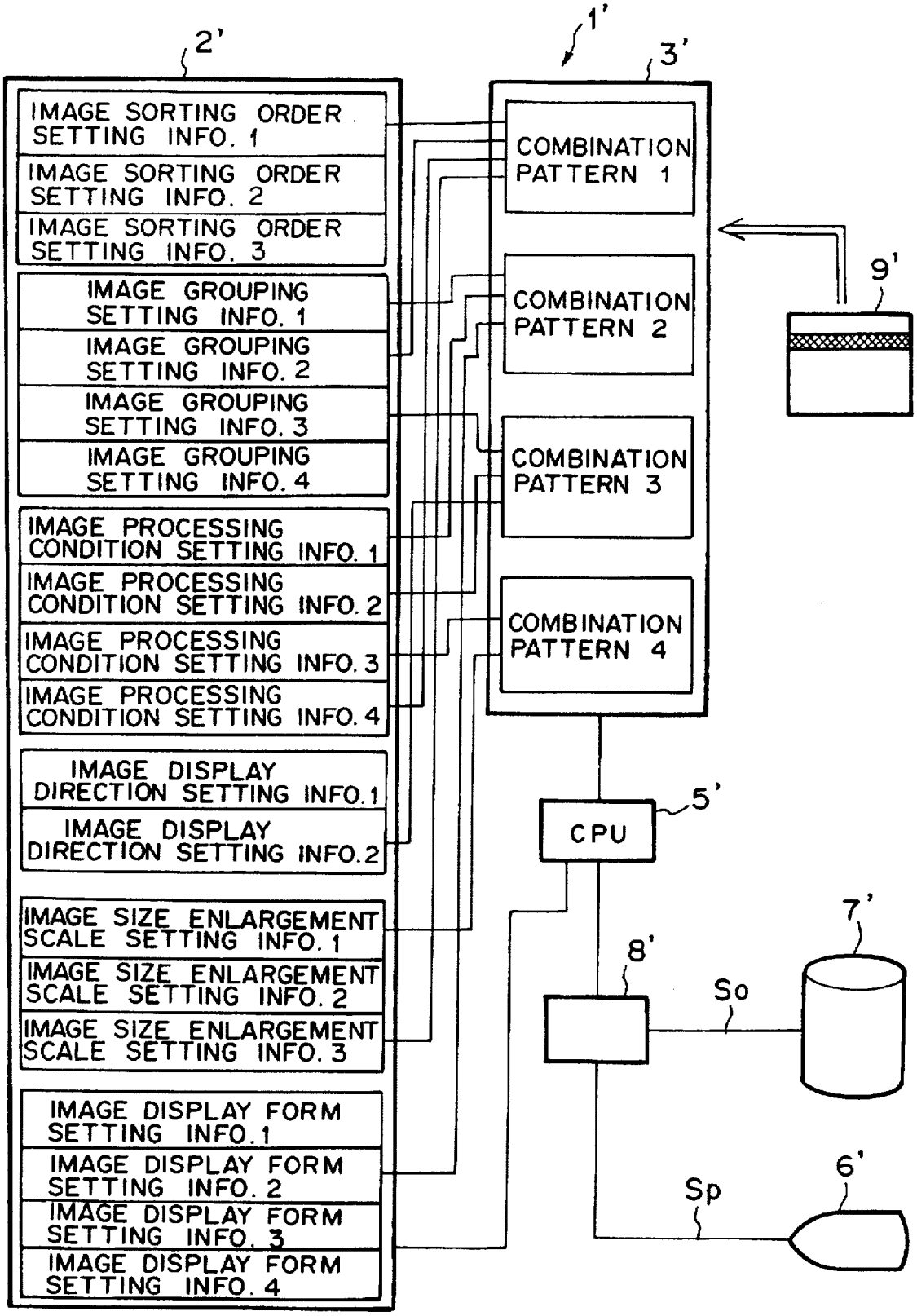
FIG. 2 is a block diagram showing a different embodiment of the image displaying apparatus in accordance with the present invention.

FIG. 2 is a block diagram showing a different embodiment of the image displaying apparatus in accordance with the present invention. In FIG. 2, similar means are numbered with corresponding primed reference numerals with respect to FIG. 1.

Specifically, in lieu of the ID information input means 4 in the image displaying apparatus 1 shown in FIG. 1, an image displaying apparatus 1' is provided with a combination pattern input means 3' for inputting a combination pattern. Also, in lieu of the ID information, a combination pattern is recorded on an ID card 9'. The combination pattern recorded on the ID card 9' is inputted to the combination pattern input means 3'.

When the combination pattern is inputted from the combination pattern input means 3', in the same manner as that in the embodiment of FIG. 1, a CPU 5' selects the pieces of setting information, which corresponds to the inputted combination pattern, from a storage means 2' and in accordance with the inputted combination pattern. For example, in cases where the combination pattern 2 is inputted from the combination pattern input means 3', the CPU 5' selects the image grouping setting information 1, the image processing condition setting information 1, and the image display form setting information 2.

Thereafter, the CPU 5' reads the image signals $S_o$ from a magnetic disk 7' and causes an image processing means 8' to process the image signals $S_o$ in accordance with the selected pieces of setting information. In accordance with the selected pieces of setting information, the image processing means 8' carries out image grouping, image processing, and setting of the image display form. Processed image signals $S_p$ are obtained from the predetermined processing carried out by the image processing means 8'. The CPU 5' feeds the processed image signals $S_p$ into a CRT display device 6'. The CRT display device 6' reproduces visible images from the processed image signals $S_p$ and displays the visible images.

As described above, with the image displaying apparatus 1' shown in FIG. 2, only by the input of the combination pattern, the pieces of setting information, which determine the display mode corresponding to the combination pattern, are selected, and the images are displayed in accordance with the selected pieces of setting information. Therefore, as in the embodiment of FIG. 1, it is not necessary for the operator to carry out the operations for selecting the desired pieces of setting information from the plurality of kinds of setting information each time the images are to be displayed. Accordingly, the images can be easily displayed in the desired display mode. Also, with the image displaying apparatus 1' shown in FIG. 2, wherein the combination pattern is inputted in lieu of the ID information, it is not necessary to make clear which combination pattern corresponds to which ID information, and the selection of the setting information can be carried out quickly.

What is claimed is:

1. An image displaying apparatus, wherein desired pieces of image display mode setting information are selected from a plurality of kinds of image display mode setting information for setting a display mode, in which images are displayed, and wherein the images are displayed in a desired display mode in accordance with the selected pieces of image display mode setting information comprising:

i) a first storage means for storing the plurality of kinds of image display mode setting information, ii) a second storage means for storing various combination patterns of the plurality of kinds of image display mode setting information, which are stored in said first storage means, iii) an input means for inputting identification information, iv) a first selection means for selecting a combination pattern, which corresponds to the inputted identification information, from said second storage means and in accordance with the inputted identification information, v) a second selection means for selecting pieces of image display mode setting information stored in said first storage means, which correspond to the selected combination pattern, from said first storage means and in accordance with the selected combination pattern, and vi) a display means for displaying the images in a display mode, which corresponds to the selected pieces of image display mode setting information.

2. An apparatus as defined in claim 1 wherein the plurality of kinds of image display mode setting information include information for setting an image display form, information for setting the order in which the images are sorted, information for setting the grouping of the images, information for setting the image processing conditions, information for setting an image display direction, and/or information for setting the scale of enlargement of an image.

3. An apparatus as defined in claim 1 wherein the images are medical images.

4. The image display apparatus according to claim 1, wherein said identification information identifies a person operating said image display apparatus.

5. The image display apparatus according to claim 1, wherein said kinds of image display mode setting information in said combination pattern are other than image signals.

6. An image displaying apparatus, wherein desired pieces of image display mode setting information are selected from a plurality of kinds of image display mode setting information for setting a display mode, in which images are displayed, and wherein the images are displayed in a desired display mode in accordance with the selected pieces of image display mode setting information, comprising:

i) a first storage means for storing the plurality of kinds of image display mode setting information, ii) a second storage means for storing various combination patterns of the plurality of kinds of image display mode setting information, which are stored in said first storage means, iii) a first selection means for selecting a combination pattern from said second storage means, iv) a second selection means for selecting pieces of image display mode setting information stored in said first storage means, which correspond to the selected combination pattern, from said first storage means and in accordance with the selected combination pattern, and v) a display means for displaying the images in a display mode, which corresponds to the selected pieces of image display mode setting information.

7. An apparatus as defined in claim 6 wherein the plurality of kinds of image display mode setting information include information for setting an image display form, information for setting the order in which the images are sorted, information for setting the grouping of the images, information for setting the image processing conditions, information for setting an image display direction, and/or information for setting the scale of enlargement of an image.

8. An apparatus as defined in claim 6 wherein the images are medical images.

9. The image display apparatus according to claim 6, wherein said kinds of image display mode setting information in said combination pattern are other than image signals.

* * * * *